United States Patent [19]

Martin

[11] Patent Number: 4,621,461

[45] Date of Patent: Nov. 11, 1986

[54] BOWLING BALL FINGER HOLE SIZING TOOL

[76] Inventor: James F. Martin, 3684 Mill St., Marion, N.Y. 14505

[21] Appl. No.: 673,491

[22] Filed: Nov. 20, 1984

[51] Int. Cl.[4] ..... B24B 25/00

[52] U.S. Cl. ..... 51/181 R; 51/391; 29/235

[58] Field of Search ..... 51/181 R, 393, 394, 51/391; 156/579; 99/421 A, 419; 29/235

[56] References Cited

U.S. PATENT DOCUMENTS

| | | | |
|---|---|---|---|
| 2,469,586 | 5/1949 | Wallace | 51/393 |
| 2,517,448 | 8/1950 | Schmeling | 99/421 A |
| 3,350,767 | 11/1967 | Yannuzzi | 29/235 |
| 3,719,460 | 3/1973 | Brockman | 51/181 R |
| 3,735,542 | 5/1973 | Kocian | 51/181 R |

FOREIGN PATENT DOCUMENTS

| | | | |
|---|---|---|---|
| 2312787 | 9/1974 | Fed. Rep. of Germany | 29/235 |

*Primary Examiner*—Harold D. Whitehead

*Attorney, Agent, or Firm*—Lawrence P. Kessler

[57] ABSTRACT

A simple, unitary tool which facilitates placement of shimming tape in the finger holes of a bowling ball and additionally can be used to enlarge the finger holes of such bowling ball. The tool comprises an elongated member and a pair of arms connected to such member. The arms respectively have a portion parallel to and spaced from the elongated member, the dimensions between such portions being less than the diameter of a bowling ball finger hole. A tape shim is threadable over the elongated member and under the arms to be retained thereby. The elongated member, with a threaded tape shim may be inserted into a bowling ball finger hole, pressed against the wall of such finger hole to transfer such tape shim to such finger hole to shim the finger hole, and then removed, leaving such tape shim properly secured to such finger hole. Additionally, the elongated member may include an abrasive surface portion spaced from the pair of arms. The abrasive surface is adapted to be selectively utilized to enlarge a bowling ball finger hole.

3 Claims, 4 Drawing Figures

BOWLING BALL FINGER HOLE SIZING TOOL

BACKGROUND OF THE INVENTION

This invention relates generally to a bowler's accessory tool, and more particularly, to a tool for readily altering the size of finger holes in a bowling ball.

One of the most popular participant sports in America today is bowling; and the most popular variation of bowling is ten pins. In ten pin bowling, a bowler throws a ball, typically weighing between ten and sixteen pounds, along a lane approximately sixty-four feet long from one end at ten bowling pins located in a triangular pattern at the opposite end. Due to the weight of the ball, it has finger holes to facilitate gripping during the throwing motion. Typically, the finger holes accommodate the thumb and two fingers. The holes in the ball are drilled at specific locations and with particular sizes tailored to the bowler's hand and finger dimensions to provide the most comfortable grip on the ball to maximize the throwing efficiency.

During a bowling session, the forces exerted on the hand during the ball-throwing action cause the bowler's fingers to swell or contract. This results in an improper fit between the fingers and the ball finger holes, with a concomitant decrease in the efficiency with which the ball is thrown. The serious bowler thus has to go to the expense of carrying a plurality of balls having respectively different finger hole sizes. This, however, does not always solve the problem of finger size change since the degree of change in finger size is not necessarily the same during each bowling session. Therefore, some bowlers carry equipment to alter the hole size such as files to enlarge the holes or tape to decrease (shim) the holes. The carrying of files, of course, adds to the amount of equipment which must be packed and cared for. Moreover, manual placement of the tape in the holes to form a smooth surface has been extremely tedious since the tape tends to stick to the finger hole (or itself) before being properly positioned within the finger hole.

SUMMARY OF THE INVENTION

This invention is directed to a simple, unitary tool which facilitates placement of shimming tape in the finger holes of a bowling ball and additionally can be used to enlarge the finger holes of such bowling ball. The tool comprises an elongated member and a pair of arms connected to such member. The arms respectively have a portion parallel to and spaced from the elongated member, the dimensions between such portions being less than the diameter of a bowling ball finger hole. A tape shim is threadable over the elongated member and under the arms to be retained thereby. The elongated member, with a threaded tape shim may be inserted into a bowling ball finger hole, pressed against the wall of such finger hole to transfer such tape shim to such finger hole to shim the finger hole, and then removed, leaving such tape shim properly secured to such finger hole. Additionally, the elongated member may include an abrasive surface portion spaced from the pair of arms. The abrasive surface is adapted to be selectively utilized to enlarge a bowling ball finger hole.

The invention, and its objects and advantages, will become more apparent in the detailed description of the preferred embodiment presented below.

BRIEF DESCRIPTION OF THE DRAWINGS

In the detailed description of the preferred embodiment of the invention, reference is made to the accompanying drawings, in which.

DESCRIPTION OF THE PREFERRED EMBODIMENT

Figure 1:
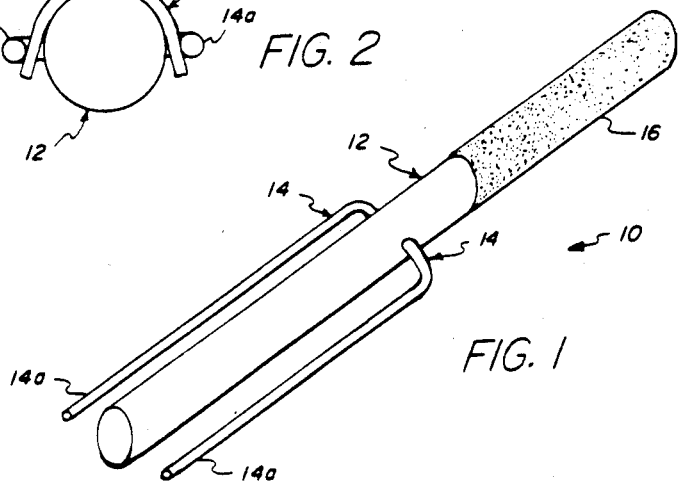
FIG. 1 is a view. in perspective of the bowling ball finger hole sizing tool according to this invention.

Referring now to the accompanying drawings, the bowling ball finger hole sizing tool, according to this invention and designated generally by the numeral 10, is best shown in FIG. 1. The tool 10, which is of simple unitary construction, comprises an elongated body member 12 substantially circular in cross-section. Of course, other cross-sectional configurations (e.g. elipsoidal) for the member are suitable for use in this invention. A pair of arms 14 are connected to the member 12 at approximately its mid-section. The arms 14, which are respectively formed for example of substantially rigid wire or thermoplastic have portions 14*a* parallel to and spaced from the member 12 adjacent to one end thereof.

Figure 2:
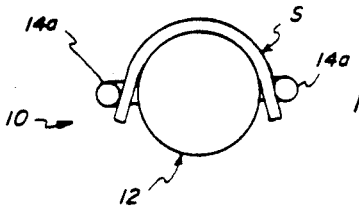
FIG. 2 is an end view of the bowling ball finger hole sizing tool of FIG. 1, showing a tape shim threaded on supported by such tool.

With the shown spacing of the arms 14 from the elongated body member, a tape shim for a bowling ball finger hole is readily threadable on the tool 10 for support by such tool (see FIG. 2). The tape shim is typically a section of polyester film having a pressure sensitive adhesive on one surface. For example, the tape shim section may be 20–30 mm long taken from a 20 mm wide roll of such polyester film. The tape shim section (e.g. section S in FIG. 2) is threaded under the arms 14 and over the portion of the body member 12 intermediate such arms with the adhesive surface facing away from the body member and toward the arms. Therefore, the tape shim section is retained on the tool 10 and maintains a curvilinear shape.

Figure 3:
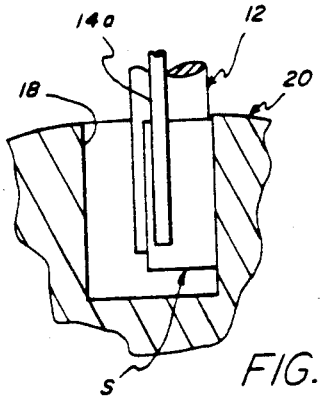
FIGS. 3 and 4 are side elevational views, in cross-section, of a bowling ball finger hole respectively showing the operational steps for utilizing the bowling ball finger hole sizing tool for shimming a finger hole.

In the preferred embodiment the diameter of the elongated body member is approximately 6 mm, while the diameter of the arms is approximately 2 mm respectively. Further, the overall dimension between the arms is approximately 14 mm. Since the typical diameter of a bowling ball finger hole is between 20 mm and 25 mm, the tool 10 is capable of being readily inserted in any such finger hole. Therefore, when the tool 10 supporting a threaded tape shim S is inserted in the finger hole 18 of a bowling ball 20, it can be urged against a side wall of the finger hole as shown in FIG. 3. The curvilinear shape of the tape shim enables the shim to readily conform to the side wall of the finger hole. The pressure exerted by the body member 12 to urge the tape shim S against the side wall of the finger hole 18 causes the tape shim adhesive surface to adhere in a desired position to the wall of finger hole.

Figure 4:
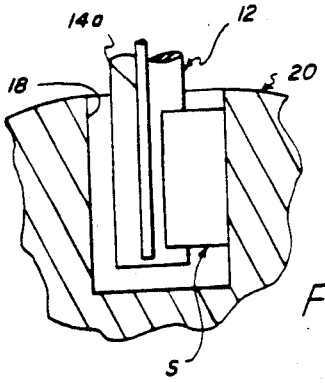

Due to the fact that the surface area of contact between the tape shim and the finger hole side wall is greater than the surface area of contact between the tape shim and the arms 14, the movement of the tool 10 to the position of FIG. 4 causes the tape shim to remain secured to the wall of the finger hole 18 in its properly located shimming position. The tool 10 may then be readily withdrawn leaving the shim properly positioned within the finger hole. This tape shim securing process may then be easily repeated until the desired degree of shimming of the finger hole is achieved for the desired fit of the bowler's finger in such hole to achieve the proper grip for maximum efficiency in throwing the ball.

Referring again to FIG. 1, the opposite end of the elongated body member 12 from the end having the spaced arms 14 has an abrasive surface 16. Such surface may be formed on sandpaper having a coarse grit (grit number 36 for example) with a pressure sensitive adhesive backing to fix the sandpaper to the member 12. Of course, other mechanisms, such as staples or glue, for securing the abrasive surface to the elongated body member are suitable for use in this invention. The abrasive surface 16 of the tool may be inserted into the bowling ball finger hole and manipulated against the wall of such hole to remove the ball material. In this manner the finger hole can be readily enlarged to a desired degree for proper fit of the bowler's finger to such hole to achieve the proper grip for maximum efficiency in throwing the ball.

From the above description, it is apparent that the tool 10 of simple unitary construction may be readily used to size a bowling ball finger hole for proper fit with a bowler's finger. If during a bowling session, the bowler's fingers swell or contract, the finger holes of the bowling ball can accordingly be shimmed or enlarged by the tool to the degree to regain proper finger fit in the hole for the desired grip to maintain the most efficient throwing action by the bowler.

The invention has been described in detail with particular reference to a preferred embodiment thereof, but it will be understood that variations and modifications can be effected within the spirit and scope of the invention.

I claim:

1. A tool for facilitating the placement of tape shims in the finger holes of bowling balls, said apparatus comprising:

an elongated member; and a pair of arms connected to said elongated member in a fixed relation said arms respectively having a portion parallel to and spaced from said elongated member the dimension between said arm portions being less than the diameter of a bowling ball finger hole, said elongated member and arms being cooperable with a tape shim threaded over said elongated member and under said arms to retain such shim on said elongated member whereby said member with a threaded tape shim may be inserted into a bowling ball finger hole, pressed against the wall of such finger hole at a desired location to transfer such tape shim to such finger hole to shim such finger hole, and thereafter removed leaving such tape shim properly secured to such finger hole at such desired location. and wherein said elongated member includes an abrasive surface portion spaced from said pair of arms, said abrasive surface being adapted to be selectively utilized to enlarge said finger hole.

2. The invention of claim 1 wherein said elongated member is substantially circular in cross-section.

3. A tool for readily altering the diameter of bowling ball finger holes, said apparatus comprising:

a substantially cylindrical body member;

abrasive material supported on said body member adjacent to one end thereof, said abrasive material adapted to be selectively inserted with said body member into a bowling ball finger hole to be utilized to enlarge such hole; and a pair of wire form arms connected in afixed relation to said body member and extending parallel to and spaced from the opposite end of said body member, the dimension between said arms being less than the diameter of a bowling ball finger hole, said elongated member and arms being cooperable with a tape shim threaded over said elongated member and under said arms to retain such shim on said elongated member, whereby a threaded tape shim may be inserted by said body member into a bowling ball finger hole and pressed against the wall of such finger hole at a desired location to transfer and secure such tape shim at such desired location to such finger hole to shim such finger hole.

* * * * *